US005112050A

United States Patent [19]

Koza et al.

[11] Patent Number: 5,112,050

[45] Date of Patent: May 12, 1992

[54] BROADCAST LOTTERY

[75] Inventors: John R. Koza, 25372 La Rena La., Los Altos Hills, Calif. 94022; John R. Ferguson, Greenbrae; Maximiano D. Torneros, Fremont, both of Calif.

[73] Assignee: John R. Koza, Los Altos Hills, Calif.

[21] Appl. No.: 461,418

[22] Filed: Jan. 5, 1990

[51] Int. Cl.[5] ..... A63F 9/24; A63F 3/06

[52] U.S. Cl. ..... 273/139; 273/138 A; 273/439; 273/269; 235/380

[58] Field of Search ..... 273/1 E, 138 A, 138 R, 273/148 R, 269, 129, 439; 235/380, 381; 364/410, 412; 902/23; 340/323 R; 455/89, 11; 370/94.1, 85

[56] References Cited

U.S. PATENT DOCUMENTS

| | | | |
|---|---|---|---|
| 3,259,389 | 7/1966 | Blondell | 273/138 |
| 3,466,775 | 9/1969 | Smith | 40/52 |
| 4,206,920 | 6/1980 | Weatherford et al. | 273/138 |
| 4,254,404 | 3/1981 | White | 273/138 A |
| 4,323,770 | 4/1982 | Dieulot et al. | 273/138 A X |
| 4,373,726 | 2/1983 | Churchill et al. | 273/138 |
| 4,540,174 | 9/1985 | Coppock | 273/138 |
| 4,592,546 | 6/1986 | Frascenda et al. | 273/1 E |
| 4,593,904 | 6/1986 | Graves | 273/1 E |
| 4,624,462 | 11/1986 | Itkis | 273/269 |
| 4,639,225 | 1/1987 | Washizuka | 434/308 |
| 4,696,054 | 9/1987 | Tsugei et al. | 455/89 |
| 4,764,666 | 8/1988 | Bergeron | 235/380 |
| 4,792,968 | 12/1988 | Katz | 379/92 |
| 4,803,487 | 2/1989 | Willard et al. | 340/825 |
| 4,882,473 | 11/1989 | Bergeron et al. | 235/380 |
| 4,941,143 | 7/1990 | Twitty et al. | 370/85.2 |

OTHER PUBLICATIONS

Data Sheet for Silicon Systems SSI204 5V Low Power DTMF Receiver.

Data Sheet for Motorola MC68HC805B6 8-Bit Microcontroller Unit.

Data Sheet for NEC Radiopager Mark III Tone and Voice Type.

Specification for a Standard Code Format for use in Wide Area Radio Paging Systems.

Data Sheet for Siemens DL1814 Alphanumeric Intelligent Display.

B. Sherwin, *Fans Must Call Right Plays in TV-Football Game,* Seattle Times (Oct. 11, 1987).

R. Lyke, *Bars, Lounges Score Big With Sports/Trivia Video Game,* Hotel & Motel Management (Jun. 13, 1988).

J. Takiff, *Talking Back to Your TV,* The Philadelphia Daily News (Nov. 4, 1988).

J. Krupinski, *Calling the (Electronic) Signals,* Long Island Newsday (Jan. 1989).

*What Bar Patrons See as Trivia, Owners Discovery is a Pot of Gold,* New York Times (Jul. 9, 1989).

C. Smith, *Bar Bosses See New Trivia Game Filling More Seats,* The Vancouver Sun (Feb. 21, 1990).

A. Pollack, *New Interactive TV Threatens the Bliss of Couch Potatoes,* New York Times (Jun. 18, 1990).

NTN TM Entertainment Network Brochure, NTC Communications, Inc. (1989).

*The NTN Monitor,* vol. 2, No. 6 (Jun. 1990).

NTN Programming Listing (Not dated, but prior to Jun. 22, 1990).

Rollie Fingers' Diamond Ball Notes (Not dated, but prior to Jun 22, 1990).

*Primary Examiner*—Edward M. Coven

*Assistant Examiner*—Jessica J. Harrison

*Attorney, Agent, or Firm*—Blakely, Sokoloff, Taylor & Zafman

[57] ABSTRACT

A game in which a player of the game acquires a ticket containing some information stored therein for comparison to information broadcasted from a transmitter. The broadcasted information contains a value, such as a number, corresponding to a winning number. The stored information is compared to the broadcasted information and if a match results, then the ticket is deemed to be a winning ticket.

38 Claims, 4 Drawing Sheets

BROADCAST LOTTERY

BACKGROUND OF THE INVENTION

1. Field of the Invention

The present invention relates to the field of electronic games and, more specifically, to electronic devices for playing games.

2. Related Disclosure

The present invention is disclosed in a Disclosure Document 220957 filed with the U.S. Patent and Trademark Office on Feb. 27, 1989.

3. Prior Art

Various games of chance and skill are well known in the prior art. One class of these games provides for a winner (or winners) based on statistical probabilities. A set of rules is established for a given game, wherein the rules account for the probabilities of winning the given game. Many of these games are well known as casino or parlor games involving dice, playing cards or turn(s) of the wheel.

Another set of games is referred to by a more commonly known of term of "lottery" games or "promotional" games. In these games a number of players are provided with a ticket. Depending on the specific type of game, the selection of the winning ticket(s) can be achieved prior to, during, or after distributing the tickets to the players. A number of the state governments in the United States conduct lotteries in which the members of the public purchase chances for winning prizes representing a portion of the total revenue from sales of such tickets.

In one popular lottery game, a person purchases a ticket for a given, predetermined price, such as $1. One name is given to this type of a lottery game is the "instant winner" game, because the winner can be determined instantly. In this game the tickets have preprinted numbers, letters and/or symbols. The numbers, letters, or symbols are typically covered by a removable opaque rub-off material or, in some cases, by a removable opaque paper flap. A certain combination provides a winning ticket. The winner's share can be fixed, variable or provide further opportunity to win. However, the number and total amount of winnings, actual or potential, is controlled by designing the number of winning tickets printed.

In another popular game called "lotto", a person purchases a ticket but selects the combination of numbers at the time of purchase. Alternatively, the person may elect to have the provider of the lotto game randomly select the combination (this commonly referred to as an "easy-pick"). Then, at a predesignated time a "drawing" is made in which a combination is chose as the winning combination. For example, in a game referred to as "6/49 lotto a player selects any six numbers out of a total of forty-nine numbers. At the drawing, six numbers are drawn to select the winner. The player having the winning combination of six numbers is declared a winner. If there are more than one winner, then the "pot" is shared by all of the winners.

There are variations to the "6/49 lotto", wherein selecting three, four or five numbers also results in a win of a smaller prize. In another variation, a seventh number is drawn as a "bonus" number at the time of the drawing. A player selecting five of the six winning numbers, plus the "bonus " number, is entitled to win an amount which is less than the amount for correctly selecting all six numbers, but more than the amount for selecting only five out of the six numbers. In other games, the player may select symbols other than numbers, such as playing cards, letters, etc.

In these lottery games, the players purchase the tickets at various authorized outlets, which are typically located at grocery, convenience or other retail stores. However, in most instances the tickets are provided in the form of a paper medium with the information printed thereon. For the lotto games, once the player's numbers are inputted into a computerized tracking system, those selected numbers are then printed on to a predesignated paper form for the player to retain. For the "instant winner" game, the winning combination is preprinted on the ticket prior to the time of purchase, so that in many instances the player at the time of purchase can determine if that player has won. Elaborate systems are available to conceal the preprinted combination, so that the preprinted combination is revealed only after purchasing the ticket. One popular technique involves "scratching-off" a masking layer to expose the underlying preprinted combination.

In most instant games, the player exposes all the preprinted information on the ticket. A certain number of tickets have preprinted information entitling the players to certain prizes. That is, the specific tickets that will win are entirely pre-determined (or "controlled") in advance at the time of manufacture.

In another type of instant game, the player exposes only some of the preprinted combinations needed to make it a winner provided the player chooses the correct portions of the ticket to expose. The specific ticket that will win are thus not-predetermined in advance. Instead, the specific tickets that will win are determined at the time the player plays the ticket. In these games, the operator of the game typically relies on the laws of probability to cause a certain predictable percentage of the tickets to win. However, it is theoretically possible for any ticket (and every ticket) to win.

However, it is to be noted that some form of paper medium, such as paper slips or cards, is retained by each of the players as a "ticket" or "receipt" so that these items can later be submitted or exchanged to claim the prize.

SUMMARY OF THE INVENTION

The present invention describes an apparatus and a method for providing a game in which winning information is broadcasted over a medium and received by a game ticket.

A player acquires a ticket to play a give game, such as a lottery game. Resident within or on the ticket is a stored value, such as a number. The stored value can, alternately, be assigned to the ticket at the time of manufacture; the stored value can be selected by the player at a time after the manufacture of the ticket and assigned to the ticket at such later time; or, the stored value can be generated randomly by the electronic apparatus within the ticket after the time of manufacture of the ticket and assigned to the ticket at such later time.

At some stage of the game, a winning value is designated, such as in a random drawing of a winning number for the game. This winning value is broadcasted over a medium, such as by radio frequency transmission.

Each ticket includes a receiver for receiving the broadcasted message containing the broadcasted winning value. The ticket has the ability to determine whether the stored value that has been assigned to the ticket is entitled to win a prize given that the winning value has been designated and broadcasted. The ticket then gives sensory information to the player, informing the player that he or she is a winner in the game.

In an alternate embodiment, the ticket contains only the stored value and an interfacing device is used to provide the coupling between the transmitted and the stored value on the ticket.

Further, a game is outlined in which a player selects a 9-digit decimal number. A winning 9-digit value is selected at various times and a player wins if the 9-digit number selected by the player matches the winning 9-digit value. A player can also win smaller prizes if the player has a partial match consisting of the last 8, 7, 6 or 5 digits.

Another game is outline in which a player selects a word from a set of preselected words and wins if the player's selected word matches the winning word drawn from the set.

DETAILED DESCRIPTION OF THE PRESENT INVENTION

An apparatus and a method for providing a broadcast lottery is described. In the following description, numerous specific details, such as specific circuits, memory device, etc., are set forth in order to provide a thorough understanding of the present invention. However, it will be obvious to one skilled in the art that the present invention may be practiced without these specific details. In other instances, well-known circuits and techniques have not been described in detail in order not to unnecessarily obscure the present invention.

In describing the present invention, the term "lottery" is used extensively to denote a particular game in which a winner (or winners) is (are) selected from a plurality of players. It is to be appreciated that the aforementioned "instant winner" and "lotto" games are just two examples of lotteries and the present invention is not limited to just such examples. The present invention need not be limited to games of chance only. Games of skill can be readily implemented without departing from the spirit and scope of the present invention.

Further, throughout the description the term "winner" is used to designate one or more winners (the singular form is used for simplicity of explanation) and the term "ticket" is used to denote that item which is provided to the player to certify his/her play. A term "value" is used throughout to refer to numbers, letters, symbols or other means of identification. Additionally, it is to be appreciated that a player need not necessarily purchase the ticket. Rather, the ticket can be given to a player for no consideration, such as for a commercial promotion. A winner can be awarded a prize or the game can be played purely for entertainment value, in which no prizes are awarded. Further, the winning prize, if any, can take various forms, including, but not limited to, money, vacation trips, tangible goods, opportunity to win additional or other prizes, accumulation of points or other recognition.

Figure 1:
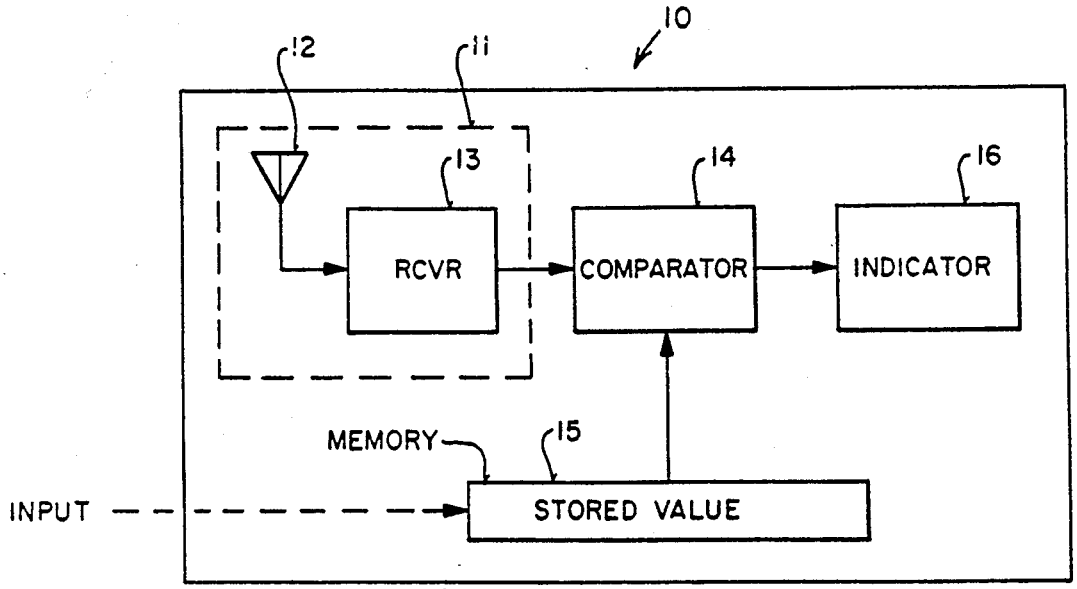
FIG. 1 is a block diagram of circuitry resident on a game ticket of the present invention.

Referring to FIG. 1, a ticket 10 used in practicing the present invention is shown. Ticket 10 is provided to each player of the lottery. As in the other lottery games, ticket 10 can be used to designate one "play" and a player may acquire more than one ticket to play the same game. Ticket 10 is comprised of a receiving means 11 for receiving a broadcasted message. Where electromagnetic radiation is to be received, receiving means 11 is comprised of an input means such as an antenna 12 and a receiver 13 for extracting the intelligence (message). Where other mediums are used for transmission, such as telephonic, optical and electro-optical mediums, microwave and laser, antenna 12 can be adapted for receiving such transmissions.

Once a signal is received, the receiver 13 recovers the message and provides this message to a comparator 14. It is to be appreciated that a variety of prior art receivers can be readily used or adapted to function as receiver 13. For example, common radio receivers can be used to receive messages sent by radio transmitters. The manner in which the message is broadcasted from a transmitting source is not critical to the present invention, as long as ticket 10 is capable of receiving and recovering the transmitted message.

The output of receiver 13, which is coupled to comparator 14, provides a message which contains a value. In the preferred embodiment this received value is digitally encoded. The receiver value is coupled as one input of comparator 14. Comparator 14 is also coupled to receive as its second input, a stored coded value from memory 15. In the preferred embodiment, this stored value is also digitally encoded. Memory 15 can be of a variety of memory devices, such as a register, an integrated circuit memory, an optical device or a magnetic memory such as a magnetic strips, etc. The preferred embodiment uses an integrated circuit memory for memory 15.

Within memory 15 a coded value is stored and retained. Comparator 14 compares the stored coded value of memory 15 to the received coded value from receiver 13. If the two coded values match, comparator 14 provides an indication to indicator 16. If "no match" occurs, a no match indication can be provided to indicator 16, or alternatively, no indication need be provided. indicator 16 will need to indicate a match condition, but need not indicate a no-match condition, although it can, if desired. The indication can be in a form noticeable to one of the senses. The preferred embodiment utilizes a visual and/or audio alarm to provide the indication. It is to be noted that memory 15 can be readily included as part of comparator 14.

In the practice of the present invention, ticket 10 is provided to a player of the lottery. Memory 15 of ticket 10 contains a coded value stored therein. It is to be appreciated that a variety of techniques can be used to store a coded value in memory 15. For example, an integrated circuit memory, such as an electrically programmable read only memory (EPROM) or an electrically programmable and electrically erasable read only memory (EEPROM) can be programmed to store the coded value. The encoded value in memory 15 can be stored when ticket 10 is manufactured or stored at a later time. In one scheme, a predesignated coded value is stored in memory 15, wherein the player acquiring ticket 10 has no choice as to the selection of the stored coded value. In another scheme, the player, prior to, at or after acquiring ticket 10, is able to select the value which is to be stored in memory 15.

Figure 2:
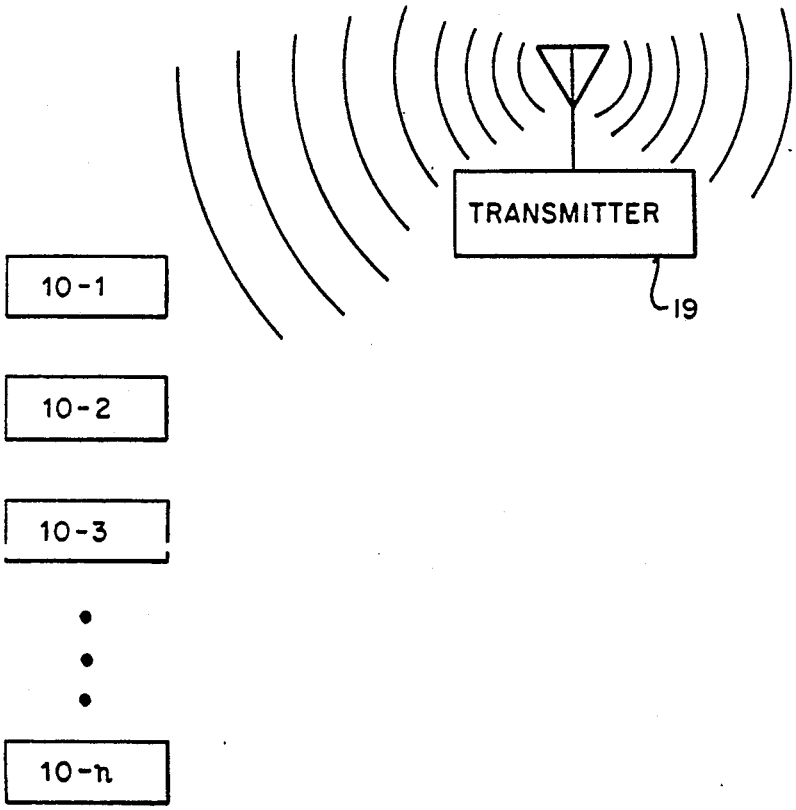
FIG. 2 is a diagram showing the broadcasting of information to a plurality of tickets.

As is shown in FIG. 2, it is appreciated that a plurality of tickets 10 are needed to play a given lottery game. The plurality of tickets 10-1 through 10-n are distributed to a plurality of players. The actual number of tickets 10, as well as the number of players, is a design choice and will depend on the type of lottery game being played. If the scheme involving predesignated coded values is used in the selected lottery game, each ticket 10 has a predesignated coded value stored with its memory 15. A different value can be stored in each ticket 10 or, alternatively, duplication can occur.

A winner of the lottery is chosen as the player having a ticket 10, which has within its memory 15 a coded value corresponding to the winning value. The winning value can be determined prior to, during or after distributing the tickets 10. If the winning value is known at the start of the lottery game, then the sponsor of the game can select the maximum possible number of winners by encoding the tickets accordingly. If the winning value is to be determined at a later time, such as by a drawing, then the sponsor ordinarily would be careful not to replicate the same code in a large number of tickets in the event that coded value is drawn, resulting in a large number of winners. Of course, the winning pot can be shared among the winners in a game have multiple winners.

At a designated time a winner is announced. The announcement is made by broadcasting the winning coded value from transmitter 19. Transmitter 19 can be of a simple hand-held device for short range operation as when providing a game in a casino, other confined physical area, or limited physical area such as a particular city, or it can be a high power unit requiring a sizeable transmitting facility for long range operation, such as when providing a State lottery game. Transmitter 19 is typically under the control of the sponsor of the lottery. In games having a significantly large number of players, the information provided to transmitter 19 can be computer controlled. At a designated time a message containing the winning code is transmitted (broadcasted) from transmitter 19 and this code is received by tickets 10. Receiving means 11 in each ticket 10 receives the transmitted message and recovers the transmitted code for processing. It is to be noted that the present invention broadcasts an unsecured message, however various security devices or techniques can be readily implemented to provide secure transmission and reception of the broadcasted message.

The winning code is coupled to comparator 14, which comparator 14 compares it to the stored code in memory 15. If the coded value stored in memory 15 is the same as the winning code received, then this match is detected by comparator 14. Comparator 14 then sends a signal to indicator 16, which provides an audio and/or visual indication that the ticket is a winning ticket. The player holding this winning ticket 10 can then proceed to the next step, which typically will be to claim an award or a prize. Multiple winners are possible where multiple winning codes are distributed.

This above described scheme having predesignated stored codes can be readily adapted to provide the earlier described "instant winner" game. The transmitter can be made to send winning code messages at frequent time intervals or even continuously.

Figure 3:
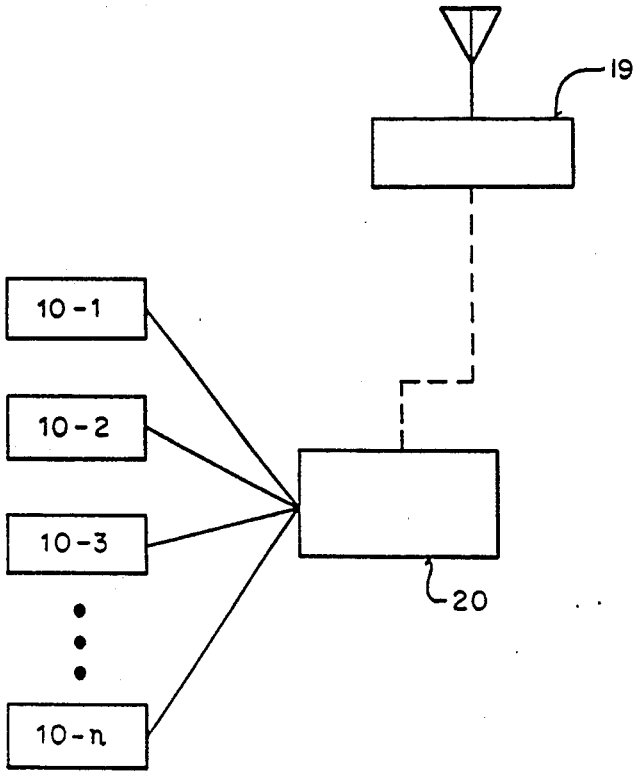
FIG. 3 is a diagram showing the use of an interfacing device to provide information to the tickets.

In the other scheme where a player is able to select the code value at the time of, or prior to, acquiring the ticket, an additional mechanism is needed to place the selected code in memory 15. FIG. 3 depicts mechanism 20 which is used to store the selected value in memory 15 of each ticket 10. The exact nature of mechanism 20 will depend on the composition of memory 15. For example if memory 15 is an EPROM, then mechanism 20 will be a "burn-in" device for programming the coded value in the EPROM. It is to be appreciated that although one mechanism 20 is shown in FIG. 3, a plurality of mechanisms 20 can be used.

This second scheme can be readily adapted to play the earlier described lotto game. For example, in a 6/49 lotto game, six numbers selected by a player are stored in memory 15. If a player chooses, the six numbers can be randomly selected (down-loaded) by the sponsor, similar to the aforementioned easy-pick. Alternatively, all the numbers can be stored in memory 15 and those chosen by a player can be activated (or those not chosen can be erased). Then the six winning numbers are broadcasted by transmitter 19 after the ticket distribution has terminated. Receiving means 11 will now need to decipher all six winning numbers. Comparator 14 must now compare the six stored numbers to the six received numbers and indicate the number of matches. Visual indication is used in the preferred embodiment where multiple indications are needed by indicator 16, but other indications can be used. In this lotto game the winning prize or award, if any, is dependent on the number of matches. Additionally, it is to be appreciated that modifications to this basic lotto game can be implemented, such as the use of a bonus (seventh) number, without departing from the spirit and scope of the present invention.

Further, in a third scheme which will be described later, an internal mechanism generates the value. This internal generation of values, which can be changed internally also, would be applicable for use in probability type of games (not pre-determined win).

Transmitter 19, which broadcasts the winning value or values, along with the transmission medium, determines the mode of the device used. Where radio transmission is used, each ticket 10 can receive and process the signal, assuming the ticket is within range of the transmitter 19. Where other broadcasting techniques are used a special receiving device may be required. In such a case, an additional device for coupling a ticket to telephone lines for receiving the broadcast will be needed. Such a device can be built into the ticket itself, however, it is more economical to have a separate device for providing the interface between the telephone lines and the ticket. Such a device would need to implement a modem (modulator-demodulator) for converting audio telephone signals to digital signals. Other forms of transmissions, including optics, electro-optics, and other electromagnetic wave transmissions can be used. Further, multiple transmitters 19 can be used to broadcast the winning value(s) instead of a single transmitter 19.

It is to be appreciated that although ticket 10 of FIG. 1 shows a specific diagram, other schemes can be implemented without departing from the spirit and scope of the present invention. For example, in some instances, all but memory 15 can be removed from ticket 10 and placed within the interface device, such as device 20 of FIG. 3. In this instance, each ticket 10 will necessarily need to be coupled to device 20 to determine if it is a winner. In some instances value(s) can be down-loaded from transmitter 19 for storage.

Further it is to be appreciated that ticket 10 can be constructed from a variety of materials and implemented in various forms. The preferred embodiment utilizes a plastic housing enclosing an integrated circuit and shaped in a substantially flat-rectangular body. However the actual shape and material are a design choice. In one instance where ticket 10 is used for a promotional purpose, ticket 10 can be incorporated in a wrist watch, pen or desk clock, such that after the lottery is run, the players retain and obtain the functionality of the watch, pen, or desk clock, etc. Further, ticket 10 of the present invention can be used once or used in a number of games.

PREFERRED EMBODIMENT

Although various games can be implemented with the present invention, an example of a specific game will illustrate the principles involved. In this game, the stored value in the ticket apparatus is comprised of a single 9-digit decimal number. The single 9-digit number might be "123456789." The game is played with a random drawing in which a winning 9-digit value is drawn every hour on all 365 days of the year. That is, there are 8760 drawings per year. In this game, the player might purchases his ticket for $87.60 per year (i.e. $0.01 per drawing). The rules of the game are such that the player wins the largest prize if his 9-digit number exactly matches the 9-digit number that is drawn on any drawing during the year. In addition, the player wins smaller prizes if he has partial match consisting of the last (right-most) 8, 7, 6, or 5 digits.

The prize structure below shows the economics of the games. The prize structure is based on 1,000,000 ticket apparatuses being sold. Thus, there is $87,600,000 in total revenue from the sales of tickets. Over the course of an entire year, there are 8,760,000,000 individual plays (8760 times 1,000,000).

| GET | PRIZE | ODDS | EXPECTED NUMBER OF WINNERS IN 8,760,000,000 | EXPECTED PRIZE COST IN 8,760,000,000 |
|---|---|---|---|---|
| Match all 9 digits | $1,000,000 | 1:1,000,000,000 | 8.76 | $8,760,000 |
| Match last 8 digits | $100,000 | 1:111,111,111 | 78.84 | $7,884,000 |
| Match last 7 digits | $5,000 | 1:11,111,111 | 788.40 | $3,942,000 |
| Match last 6 digits | $500 | 1:1,111,111 | 7,884.00 | $3,942,000 |
| Match last 5 digits | $200 | 1:111,111 | 78,840.00 | $15,768,000 |
| | TOTAL | 1:100,000 | 87,600.00 | $40,296,000 |

The odds that the 9-digit value residing on any particular ticket apparatus will exactly match the 9 digits drawn at any particular drawing are 1 in 1,000,000,000. Thus, over the course of the entire year, one can expect that there will be 8.76 such exact matches among the 8,760,000,000 individual plays. If the prize for such an exact match is $1,000,000 cash, then the expected prize cost for the entire year is $8,760,000.

In addition, in the course of a year, one can expect 87.60 occasions when the last (right most) 8 digits on some players' tickets will partially match the 9-digit number drawn. Excluding the expected 8.76 occasions when there will be an exact match, there will then be expectation of 78.84 partial matches of 8 digits. If a prize of $100,000 cash is awarded for such a partial match, then the expected prize cost will be $7,884,000. The odds of such a partial match are 1 in 111,111,111 (i.e. 8,760,000,000 divided by 78.84).

The odds, expected number of winners, and expected prize cost are computed in a similar manner for partial matches of 7,6, and 5 digits. The total expected prize cost for the entire game is thus $40,296,000 for the year. This amounts to 46% of the revenues from the game. Many state-operated government lotteries pay out approximately 46% of their revenues in prizes to the players. Thus, the above prize structure might be a viable prize structure for many state-operated lottery games. There is an expectation of 87,600 winners so that the odds of winning will be 1:100,000 for any individual play. Since each ticket apparatus participates in 8,760 individual plays in the course of the year, the odds of winning for a particular ticket apparatus sometimes during the year are about 1 in 11.4.

The 9-digit winning value that is randomly drawn is broadcast to all players immediately after each drawing. There will be 8,760 such broadcasts during the year. A typical broadcast message will contain two (**), two decimal digits indicating the total length of the current message, one decimal digital indicating the particular game being played (among all such games that might be simultaneously played and broadcast), four decimal digits indicating the particular drawings number (1 through 8760), nine decimal digits indicating the 9-digit winning value drawn, two decimal digits for a check code to verify accuracy of transmission of the message, and two ending symbols (). Thus, the total length of the message would be 22 symbols. These 22 symbols do not include the preliminary address code which may also be transmitted by a particular protocol, such as by a Motorola BPR broadcast and network system.

For example, suppose that the 9-digit value 444444444 is drawn on the 8760th drawing of the year (i.e. the last drawing of the year) for game no. 1. The message would than be **221876044444444437. This message is interpreted as follows: The message has length 22, applies to game no. 1, relates to the 8760th drawing of the year, reports that the winning value for the drawing is 444444444, and has the check code 37 for verifying the accuracy of transmission. If the particular ticket apparatus has stored value 123456789 for game no. 1, it would not be a winner for this particular drawing.

Figure 4:
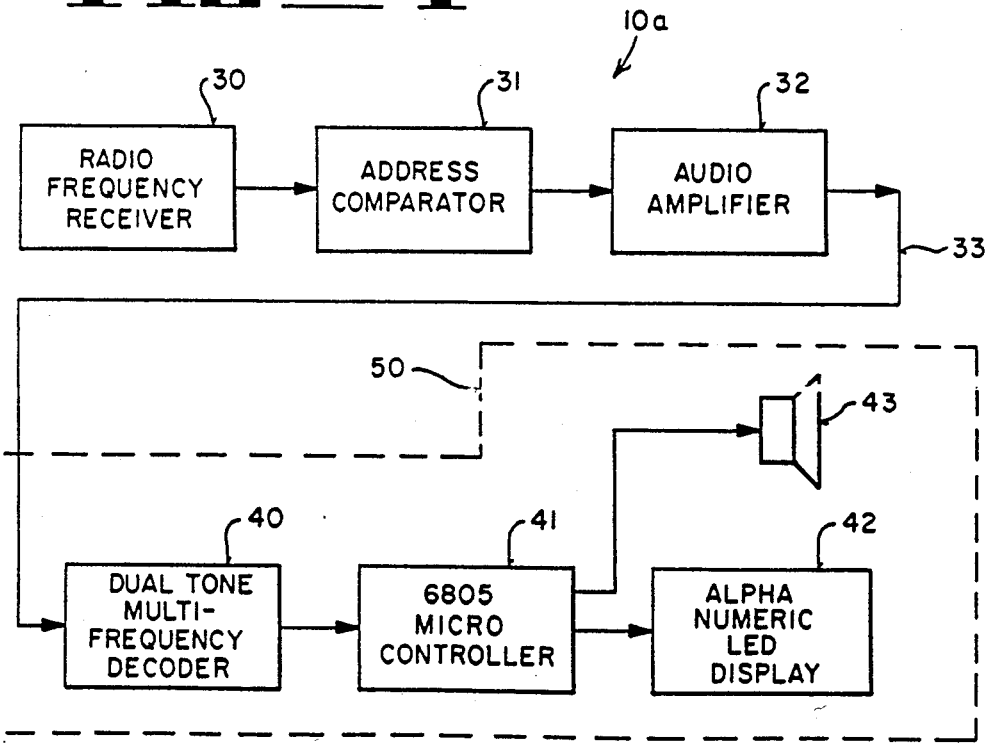
FIG. 4 is a block diagram showing additional detail of a circuitry resident on a game ticket of the present invention.

FIG. 4 provides an illustration concerning a specific circuitry used in the preferred embodiment. It is to be appreciated that although a specific example, including a specific network, is described, other circuitry and networks can be readily implemented without departing from the spirit and scope of the present invention.

A broadcast message is broadcast by a Motorola BPR 2000 regional network. As an illustration of this network, Pacific Telesis (Pactel) broadcasts using the Motorola BPR 2000 system, in which more than 100 transmitters in the San Francisco Bay Area use a frequency of 152.24 Megahertz for the area approximately within 20 miles of downtown San Francisco and use a frequency of 929.8875 Megahertz for the wider area from Monterey to Fresno and Marysville, Calif. The voice feature of the Motorola BPR allows the sending of messages to the individual apparatus by using touch tones from a standard telephone. These tones are relatively insensitive to noise and distortion.

The broadcast message is received by a radio frequency (RF) receiver 30 of apparatus 10*a*, which operates substantially equivalent to ticket 10 of FIG. 1 in overall function. Part of the broadcast message is an address code which is used to identify the broadcast message as one appropriate for the particular game and apparatus. The address in the broadcast message is compared to the address stored in address comparator 31. If the addresses agree, the message received is then passed on to an audio amplifier 32. The amplifier 32 amplifies the signal received from comparator 31.

The output signal 33 from the audio amplifier 32 is then coupled to a Dual Tone Multi-Frequency (DTMF) decoder 40. A Motorola 6805 Microcontroller is used as a processor 41 in the preferred embodiment and makes periodic inquires of the DTMF decoder 40. When a valid 4-bit signal (representing up to 16 different possibilities) is present at decoder 40 at the time of inquiry, this information is provided to the microcontroller 41. The microcontroller 41 continues to make such inquires of decoder 40 until a complete message comprising of a sequence of such 4-bit signals is accumulated in microcontroller 41. For example, the entire message (excluding the address code) can be comprises of 22 such 4-bit hexadecimal symbols.

In this particular embodiment, the microcontroller 41 contains the stored value(s) for the player. The microcontroller 41 then determines if the stored value for the player is a winner in the game given the message received. This determination is made based on the particular rules and prize structure of the particular game being played. If, for example, the stored value for the player is the 9-digit number 123456789 and the broadcast wining value is 333333333, then this particular ticket apparatus is not a winner on this particular occasion. If, on the other hand, the broadcast winning vale is 999956789, then this particular ticket apparatus is a winner by virtue of having a partial match consisting of the last (right-most) five digits 56789.

If the stored value for the player is a winner in the game, the microcontroller 41 causes an audio alarm 43, such as a beeper, to emit an audible sensory indication to the player. In addition the microcontroller 41 causes a visual indicator 42, such as an alpha-numeric light emitting diode (LED) display device, to display a visual alpha-numeric message to the player (such as "Win $200"). If the stored value for the player is not a winner in the game, the Microcontroller 41 does not activate the beeper 43. It can, however, display the 9-digit winning value on the LED 42. As can be appreciated, microcontroller 41 includes software routines for providing the necessary programming and operation of device 10*a*.

Figure 5:
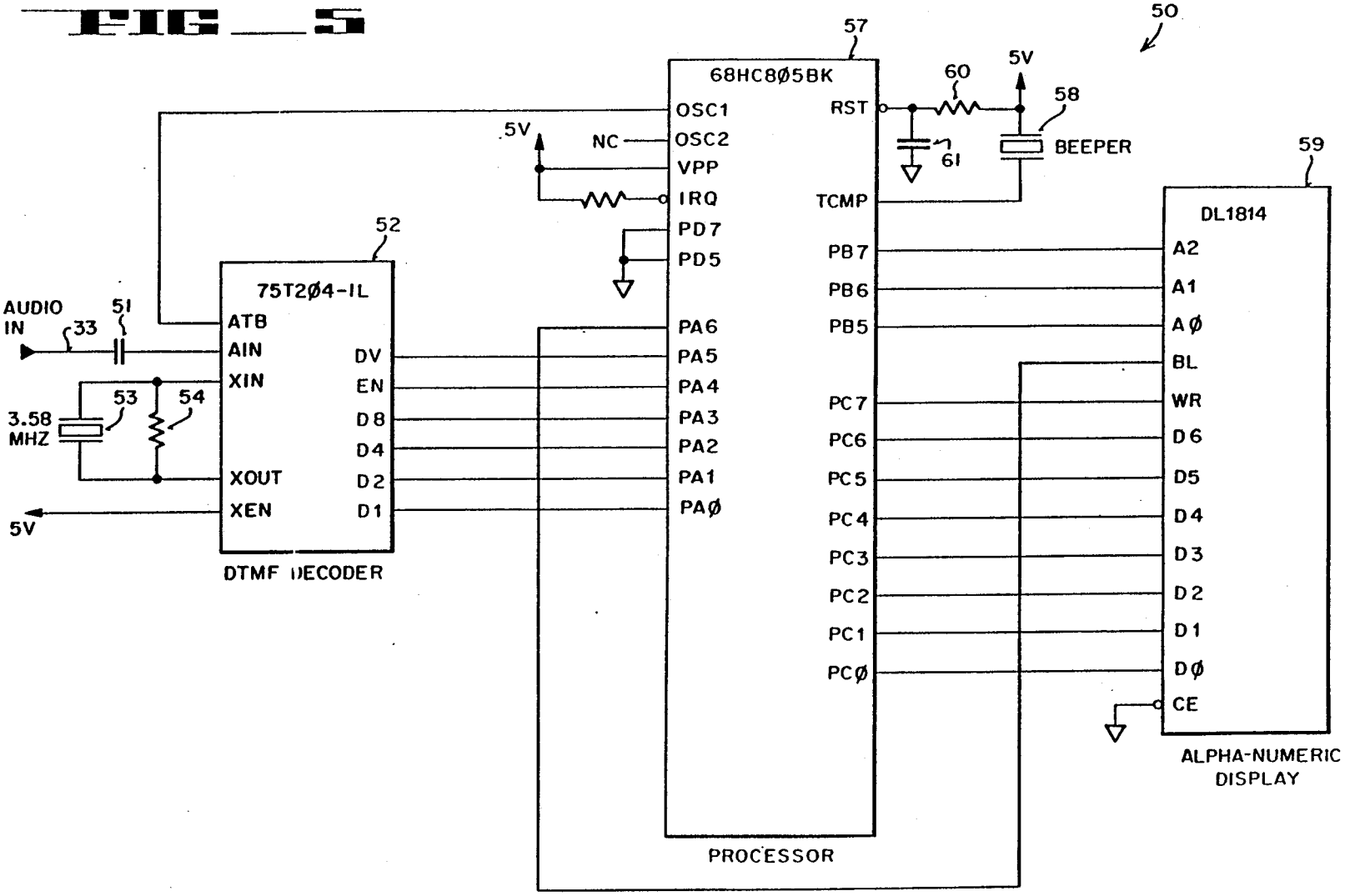
FIG. 5 is a schematic diagram showing additional detail of a circuitry processing a signal received by the circuitry resident on a game ticket of the present invention.

Referring to FIG. 5, it provides additional details of the portion 50 of the circuitry, as represented by units 40–43 of FIG. 4. The audio signal 33 from amplifier 32 of FIG. 4 is coupled as an input to circuit 50.

The DTMF decoder 40 is implemented by a microprocessor chip 52, specifically a Silicon Systems 75T204-IL chip. This chip 52 converts the 16 standard DTMF touch-tone tones generated by a touch-tone telephone into a 4-bit hexadecimal code. The audio input signal is coupled through a capacitor 51, which is a 0.01 micorfarad (μF) capacitor, to pin input AIN of decoder chip 52. Decoder chip 52 calls on a standard color-burst crystal 53 operating at 3.579545 Megahertz and a resistor 54 coupled in parallel across pins labeled XIN and XOUT on the 75T204-IL decoder chip 52.

The microcontroller 41 of FIG. 4 is implemented as a microprocessor controller chip 57 in FIG. 5. Inquiries to decoder chip 52 are initiated by the controller chip 57 at the EN pin of decoder 52. The DV pin responds to such inquires by indicating the presence of a valid single touch-tone signal. Each such signal is one of 16 possibilities (hexadecimal). The D1, D2, D3, and D4 pins, respectively, provide the 4-bit signal (hexadecimal signal) representing the single touch-tone tone to the controller chip 57.

The microprocessor controller chip 57 of the preferred embodiment is a Motorola MC68HC805BK chip. This chip is one of the 6805 family of chips. This chip 57 is a highly compact chip packaged in a small 28 lead SOJ (surface mount) package. The controller chip 57 uses the block output of the decoder chip 52 as a time base. The controller chip 57 contains 2 K bytes of PROM implemented as an Electrically Erasable Programmable Read Only Memory (EEPROM), 128 bytes of scratchpad Random Access Memory (RAM), and 21 Input/Output (I/O) lines. This microprocessor controller chip 57 does the work of interpreting the broadcast signal into game terms. In particular, it accumulates the single hexadecimal touch-tone signals into a complete message. This message is comprised of a designated special starting symbol and a designated special ending symbol as described. This message contains a field indicating the specific game involved and additional fields containing the broadcast values for the game. The controller chip 57 determines whether the stored values in the chip are a winner for the game given the broadcast values.

The functionality of the microprocessor controller chip 57 derives from its internal program. This program resides in the EEPROM of chip 57 and is inserted into this EEPROM using the Motorola Development System M68HC05EVM and a computer terminal.

The beeper 43 from FIG. 4 is implemented as a piezoelectric transducer 58 and is connected to a resistor 60 and capacitor 61. It is coupled to the RST pin of chip 57 through resistor 60 and the other terminal to the TCMP pin of chip 57. Capacitor 61 is coupled between the RST input and ground. A supply voltage, 5V in this instance, is coupled to the junction of transducer 58 and resistor 60. In the preferred embodiment resistor 60 is 10 K ohms and capacitor 61 is 1.0 μF. This piezo-electric transducer 58 produces an audible sensory indication of a winner upon command of chip 57.

The alpha-numeric LED display 42 of FIG. 4 is implemented as display device 59 in FIG. 5. The display device 59 is a Siemens DL1814 red 8-character LED display device. Each character is composed of 16 segments and is 0.112 inches high. Any of 64 characters may be displayed using this display device 59, including all numbers and all upper case letters.

The preferred embodiment is powered off a standard 6 volts batteries. Voltage dividers provide the 1.5 volt power required by units 30, 31 and 32 of FIG. 4, the 5.0 volt power required by units 40–43 (units 52, 57–59 in FIG. 5).

It is anticipated that existing trends toward improvements in performance and price in the electronics industry will cause the power requirements, physical size, and cost of the components performing the fundamental operations of this apparatus described herein to decrease dramatically over time.

In the description above, the stored values of the game for the player are stored in the memory of the microprocessor controller chip 57. These stored values of the game for the player may be determined at the time of manufacture of the apparatus. Different values would typically be inserted into different parts. However, it is possible for the player to select his or her own values of the game. As described earlier, this can be accomplished by connecting the apparatus to an impregnating device which inserts the values of the game chosen by the player into the apparatus. This impregnating device might be located at retail locations, such as a store which sells the lottery tickets or distributes the promotional game tickets.

Figure 6:
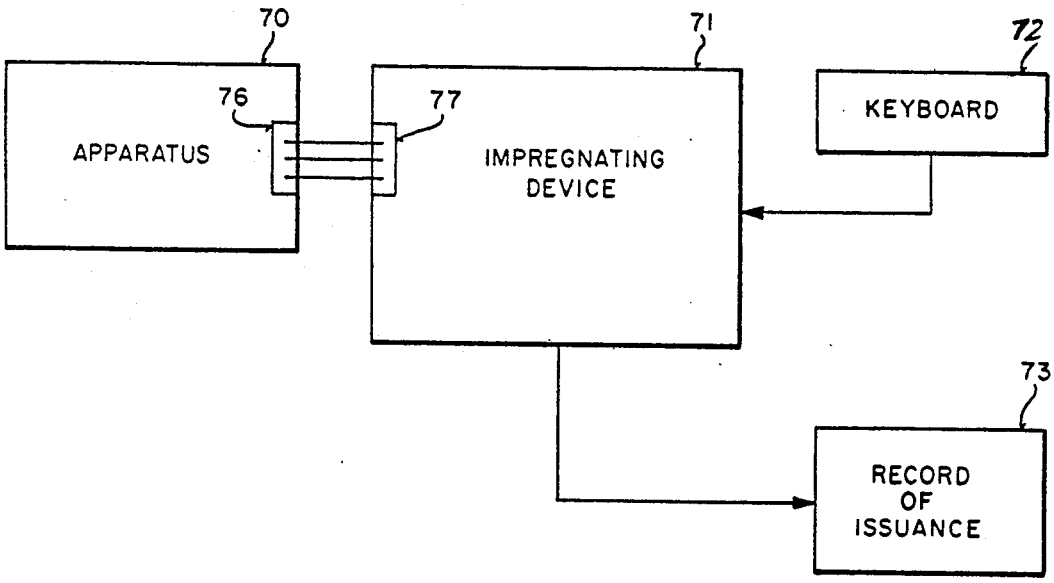
FIG. 6 is a diagram showing the selection of a value by a player, an assignment of the selected value to a ticket by an impregnating device, and a recording of such selection at a central information repository.

FIG. 6 is a diagram showing a selection of a value by the player, an assignment of the selected value to the ticket by an impregnating device, and a recording of such selection at a central information repository. In FIG. 6, an apparatus 70 (i.e. the game ticket) is presented by a player at the retail location. The apparatus 70 is connected to an impregnating device 71 via a connector 76 of the apparatus 70 and connector 77 of the impregnating device 71. A keyboard 72 coupled to the impregnating device 71 allows the entry of the values of the game desired by the player. This keyboard may be operated by either player or a clerk and be part of a vending machine and could further be with a coin slot. The impregnating device 71 causes signals to be created and transmitted to the apparatus 70 and entered into a memory resident on the apparatus 70. The EEPROM of the microprocessor controller chip 57 will provide that function when controller chip 57 is used in the apparatus 70.

Appropriate validation and security codes accompany the game values to assure the validity of the game values in event of a win. Before a prize is paid, the stored game values of the player must qualify for a prize given the broadcast values and, in addition, the stored game values must agree with an encrypted version of the stored game values in the apparatus, as well as with a record 73 of the stored game value and an additional validation code created at the time of issuance of the game value, retained at a central site operated by the sponsor of the game. It is appreciated that the earlier described apparatus of FIGS. 4 and 5 can be readily used to provide apparatus 70.

It is to be noted that it is also possible that the player could choose to allow the impregnating device to randomly generate the new game values for his apparatus (i.e. the easy pick) and impregnate such new random values in his apparatus. Also the new game values could be supplied via a separate paper game ticket, in the form of an optically scannable printed bar-code, optically readable printed characters, information encoded on a magnetic strip or other such means.

The impregnating device 71 creates a record 73 of issuance of the game value selected by the player. The record of issuance would typically be a signal sent via dedicated telephone lines to a central computer maintained by the sponsor of the lottery or promotional game; however, this record of issuance could also be in the form of a printed paper record or a magnetic memory device (such as a floppy disk). This signal contains the game values selected, as well as the time and date of issuance and other administrative information appropriate to the game.

Finally, it is possible for the game values to be generated by the controller chip 57 itself using a program. This program would generate a sequence of game values using a pseudo-random algorithm. Such pseudo-random algorithms are well known in the prior art and are capable of generating a sequence of seemingly random, seemingly unpredictable, and seemingly unrelated game values. However, in fact, the entire sequence of such seemingly random values is generated in an entirely deterministic way by the mathematical algorithm involved and thus capable of precise verification of validity in event of a win. Then, as each new winning value is broadcast, the apparatus determines whether the newly computed, seemingly random stored value in the apparatus is a winner in the game given the broadcast values.

Thus, the stored values of the game in the ticket apparatus may arise in any one of the three ways, namely, created at the time of manufacture, created as a result of a selection and request initiated by the player, or internally created by the microprocessor controller in the apparatus just prior to the broadcast of the winning values.

It is to be appreciated that although a particular game is outlined in the practice of the preferred embodiment, the present invention can be readily adapted to other games in that there are many types of game values that may be on a ticket. Lottery games and promotional games often use a single multi-digit number, such as a 6-digit number for example. Other games use multiple multi-digit numbers, often of varying lengths. Still other games use a group of numbers, such as the grouping of 6 numbers from 1 to 49 as used in the "lotto" games. Further, other games use symbols or groups of symbols, such as symbols of playing cards (e.g. Ace of Hearts, etc.) or letters of the alphabet. Some games allow repetition of the digit or symbols in the game value, while other games do not allow repetition. For example, the digits 0–9 may recur in any of the 6 positions in a 6-digit number, while the numbers 1–49 used in a typical lotto game and the playing cards in a typically card game do not recur.

A variation of the lottery game can be provided using words of a given language, such as English. In an alternative implementation of the preferred embodiment, a player selects a word from a collection of preselected words and wins if the player's selected word matches the winning word drawn from the set. The set of words can be provided to the players by various means, including floppy disks, CD-ROM compact disks or other reference to an established dictionary.

Similarly, there are many variations in the types of values that may be broadcast. In some games, there is only one number drawn, for example one 6-digit number may be drawn, while in other games, multiple numbers may be drawn. In some games, there may be repetitions among the numbers drawn, while in other games, such as lotto, there are no such repetitions.

The type of broadcast need not be limited to telephone or RF transmission. It may be microwave, x-ray, light from a laser, as well as other well-known transmission means. Further, one or multiple broadcasting points can be used.

The types of games include, but is not limited to, (1) games where the ticket is given to the player for no consideration (e.g. a promotional game) and can win a prize; (2) games where the ticket is purchased by the player (e.g. a state-operated lottery) and can win a prize; and (3) games where the ticket can be purchased or given away where the game is played for entertainment or amusement and cannot win a tangible prize, but may win points or other recognition.

There are games of chance and games of skill. Both may be practiced by the apparatus described herein. Most state-operated lottery games are games of chance. However, the broadcast values may be the outcome of a sporting contest, such a football game, and the stored values of the game for a player may be that particular player's bet on the outcome of the sporting contest. Such games require skill by the player making his chose of a bet on the outcome of the game.

It is also appreciated that various additional schemes and techniques well known in the art, which are associated with portable memory devices, credit cards and lottery tickets, can be readily adapted to function with the present invention. For example, security means for preventing unauthorized alteration of the values or the range of values can be readily included within the "ticket" of the present invention, as well as means to render the "ticket" inoperable if such unauthorized alteration is attempted.

Additionally, it is appreciated that although a specific circuit is shown as the preferred embodiment, other circuits can be readily implemented to practice the present invention without departing from the spirit and scope of the present invention.

What is claimed is:

1. A portable electrical ticket apparatus for a game, comprising:

a radio frequency receiver for receiving a broadcast of a dual-tone multifrequency signal containing a winning variable for the game, wherein the broadcast signal is broadcast over a transmission medium;

a dual-tone multifrequency decoder for decoding the broadcast signal received into a multibit decoded signal;

storage means for storing a first variable;

a central processing unit coupled to the decoder and to the storage means for ascertaining whether the first variable stored in the storage means is the winning variable in view of the multibit decoded signal.

2. The portable electrical ticket apparatus of claim 1, wherein the winning variable is a winning number and the first variable is first number.

3. The portable electrical ticket apparatus of claim 1, wherein the winning variable is a winning word and the first variable is a first word.

4. The portable electrical ticket apparatus of claim 1, wherein the winning variable is a winning outcome of a sporting event and the first variable is a first outcome of the sporting event.

5. The portable electrical ticket apparatus of claim 1, further comprising means for generating the first variable.

6. The portable electrical ticket apparatus of claim 5, wherein the means for generating the first variable comprises a pseudo-random generator.

7. The portable electrical ticket apparatus of claim 1, further comprising an address comparator for comparing the broadcast signal to an address stored within the portable electrical ticket apparatus in order to determine whether the broadcast signal is appropriate for the game.

8. The portable electrical ticket apparatus of claim 1, wherein the central processing unit and the storage means are included within a microcontroller.

9. The portable electrical ticket apparatus of claim 1, further comprising indicator means responsive to the central processing unit for providing an indication that the first variable is the winning variable if the first variable is the winning variable.

10. The portable electrical ticket apparatus of claim 9, wherein the indicator means includes a visual indicator for providing a visual indication.

11. The portable electrical ticket apparatus of claim 10, wherein the visual indicator is an alphanumeric display.

12. The portable electrical ticket apparatus of claim 9, wherein the indicator means includes a sound generation device for providing an audio indication.

13. The portable electrical ticket apparatus of claim 1, further comprising means for rendering the portable electrical ticket apparatus inoperable if there is an unauthorized alteration of the first variable.

14. A ticket system for a game, comprising:

(a) a transmitter for broadcasting a dual-tone multifrequency signal containing a winning variable for the game over a transmission medium;

(b) a portable electrical ticket apparatus comprising:

(1) a radio frequency receiver for receiving a broadcast of the dual-tone multifrequency signal;

(2) a dual-tone multifrequency decoder for decoding the broadcast signal received into a multibit decoded signal;

(3) storage means for storing a first variable;

(4) a central processing unit coupled to the decoder and tot he storage means for ascertaining whether the first variable stored in the storage means is the winning value in view of the multibit decoded signal.

15. The ticket system of claim 14, wherein the winning variable is a winning number and the first variable is a first number.

16. The ticket system of claim 14, wherein the winning variable is a winning word and the first variable is a first word.

17. The ticket system of claim 14, wherein the winning variable is a winning outcome of a sporting event and the first variable is a first outcome of the sporting event.

18. The ticket system of claim 14, further comprising impregnating means for impregnating the storage means with the first variable.

19. The ticket system of claim 14, further comprising means for generating the first variable.

20. The ticket system of claim 19, wherein the means for generating the first variable comprises a pseudo-random generator.

21. The ticket system of claim 14, wherein the portable electrical ticket apparatus further comprises means for generating the first variable.

22. The ticket system of claim 21, wherein the means for generating the first variable comprises a pseudo-random generator.

23. The ticket system of claim 14, wherein the portable electrical ticket apparatus further comprises an address comparator for comparing the broadcast signal to an address stored within the portable electrical ticket apparatus in order to determine whether the broadcast signal is appropriate for the game.

24. The ticket system of claim 14, wherein the central processing unit and the storage means are included within a microcontroller.

25. The ticket system of claim 14, wherein the portable electrical ticket apparatus further comprises indicator means responsive to the central processing unit for providing an indication that the first value is the winning value if the first value is the winning value.

26. The ticket system of claim 25, wherein the indicator means includes a visual indicator for providing a visual indication.

27. The ticket system of claim 26, wherein the visual indicator is an alphanumeric display.

28. The ticket system of claim 25, wherein the indicator means includes a sound generation device for providing an audio indication.

29. A method of playing a game, comprising the steps of:

generating a word;

storing an electrical representation of the generated word in storage means within a portable electrical ticket apparatus;

broadcasting by radio frequency transmission a signal containing an electrical representation of a winning word for the game;

receiving within the portable electrical ticket apparatus the radio frequency transmission of the broadcast signal containing the electrical representation of the winning word;

comparing within the portable electrical ticket apparatus the stored electrical representation of the generated word with the electrical representation of the winning word;

providing an indication emanating from the portable electrical ticket apparatus that the generated word is the same as the winning word if the generated word is the same as the winning word.

30. The method of claim 29 of playing a game, wherein the step of generating a word comprises having a player of the game select a word.

31. The method of claim 29 of playing a game, further comprising the step of comparing within the portable electrical ticket apparatus the broadcast signal to an address stored within the portable electrical ticket apparatus in order to determined whether the broadcast signal is appropriate for the game.

32. The method of claim 29 of playing a game, wherein the indication emanating from the portable electrical ticket apparatus is a visual indication.

33. The method of claim 29 of playing a game, wherein the indication emanating from the portable electrical ticket apparatus is an audio indication.

34. A method of playing a game, comprising the steps of:

generating a possible outcome of a sporting event;

storing an electrical representation of the generated outcome in storage means within a portable electrical ticket apparatus;

broadcasting by radio frequency transmission a signal containing an electrical representation of a winning outcome for the sporting event;

receiving within the portable electrical ticket apparatus the radio frequency transmission of the broadcast signal containing the electrical representation of the winning outcome;

comparing with the portable electrical ticket apparatus the stored electrical representation of the generated outcome with the electrical representation of the winning outcome;

providing an indication emanating from the portable electrical ticket apparatus that the generated outcome is the same as the winning outcome if the generated outcome is the same as the winning outcome.

35. The method of claim 34 of playing a game, wherein the step of generating a possible outcome of a sporting event comprises having a player of the game select a possible outcome of a sporting event.

36. The method of claim 34 of playing a game, further comprising the step of comparing within the portable electrical ticket apparatus the broadcast signal to an address stored within the portable electrical ticket apparatus in order to determine whether the broadcast signal is appropriate for the game.

37. The method of claim 34 of playing a game, wherein the indication emanating from the portable electrical ticket apparatus is a visual indication.

38. The method of claim 34 of playing a game, wherein the indication emanating from the portable electrical ticket apparatus is an audio indication.

* * * * *